US009254028B2

(12) United States Patent
Gueret

(10) Patent No.: US 9,254,028 B2
(45) Date of Patent: Feb. 9, 2016

(54) APPLICATOR AND A PACKAGING AND APPLICATOR DEVICE INCLUDING SUCH AN APPLICATOR

(71) Applicant: L'OREAL, Paris (FR)

(72) Inventor: Jean-Louis Gueret, Paris (FR)

(73) Assignee: L'OREAL, Paris (FR)

( * ) Notice: Subject to any disclaimer, the term of this patent is extended or adjusted under 35 U.S.C. 154(b) by 234 days.

(21) Appl. No.: 13/953,463

(22) Filed: Jul. 29, 2013

(65) Prior Publication Data

US 2014/0003857 A1 Jan. 2, 2014

Related U.S. Application Data

(63) Continuation of application No. 13/810,785, filed as application No. PCT/IB2011/053111 on Jul. 12, 2011, now abandoned.

(60) Provisional application No. 61/368,914, filed on Jul. 29, 2010.

(51) Int. Cl.

| | |
|---|---|
| ***A46B 11/00*** | (2006.01) |
| ***A45D 40/26*** | (2006.01) |
| ***A46B 9/02*** | (2006.01) |
| ***A46D 1/00*** | (2006.01) |

(52) U.S. Cl.

CPC ..... *A45D 40/262* (2013.01); *A45D 40/265* (2013.01); *A46B 9/021* (2013.01); *A46D 1/0238* (2013.01); *A46B 2200/1046* (2013.01); *A46B 2200/1053* (2013.01)

(58) Field of Classification Search

CPC ..... A46B 9/021; A46B 2200/1046; A46B 2200/1053; A45D 40/262; A45D 40/265

USPC ..... 401/126, 129; 132/218

See application file for complete search history.

(56) References Cited

U.S. PATENT DOCUMENTS

| | | | | |
|---|---|---|---|---|
| 6,412,496 | B1 * | 7/2002 | Gueret | 132/218 |
| 6,539,950 | B1 * | 4/2003 | Gueret | 132/218 |

(Continued)

FOREIGN PATENT DOCUMENTS

| | | |
|---|---|---|
| EP | 1 169 940 | 1/2002 |
| EP | 2 084 987 | 8/2009 |

(Continued)

OTHER PUBLICATIONS

International Search Report Issued Dec. 7, 2011 in PCT/IB11/53111 Filed Jul. 12, 2011.

*Primary Examiner* — Jennifer C Chiang

(74) *Attorney, Agent, or Firm* — Oblon, McClelland, Maier & Neustadt, L.L.P.

(57) ABSTRACT

An applicator for applying a composition to the eyelashes or the eyebrows, the applicator including an applicator member, having a core that extends along a longitudinal axis; and at least three rows of applicator elements that are molded with at least one portion of the core, the rows extending longitudinally along the core, and being arranged around the longitudinal axis of the core, the applicator elements being of cross-section that is flat, having a major axis that is oriented substantially perpendicularly to the longitudinal axis (X) of the core, at least two applicator elements having bases that are offset angularly around the longitudinal axis (X) of the core and being superposed, at least in part, when the core is observed along its longitudinal axis (X).

15 Claims, 4 Drawing Sheets

(56) References Cited

U.S. PATENT DOCUMENTS

| | | | | |
|---|---|---|---|---|
| 6,691,716 | B2 * | 2/2004 | Neuner et al. | 132/218 |
| 8,336,560 | B2 * | 12/2012 | Dumler et al. | 132/218 |
| 2002/0014251 | A1 | 2/2002 | Gueret | |
| 2008/0219748 | A1 | 9/2008 | Salciarini | |
| 2009/0193602 | A1 | 8/2009 | Dumler et al. | |

FOREIGN PATENT DOCUMENTS

| | | |
|---|---|---|
| FR | 2 912 620 | 8/2008 |
| WO | 2010 013213 | 2/2010 |

* cited by examiner

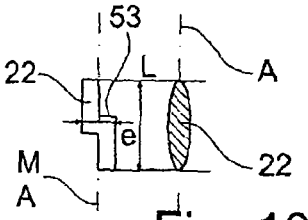
Fig. 10B
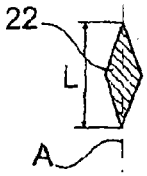
Fig. 10C
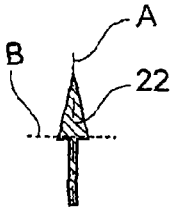
Fig. 10D
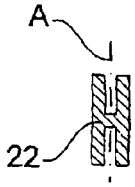
Fig. 10F
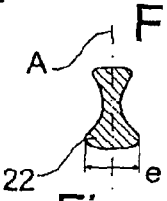
Fig. 10E
Fig. 10A
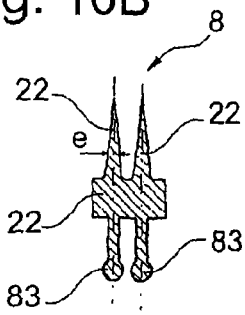
Fig. 16
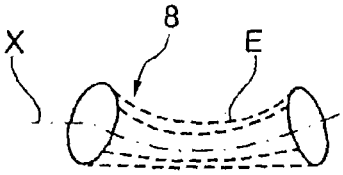
Fig. 15
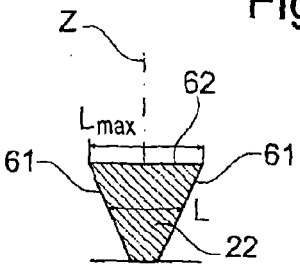
Fig. 11A
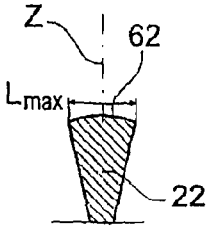
Fig. 11B
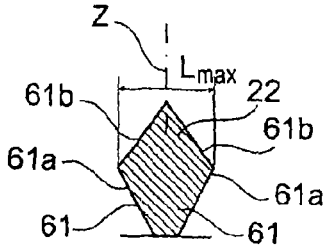
Fig. 11C
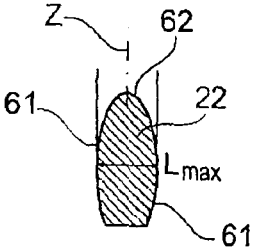
Fig. 11D
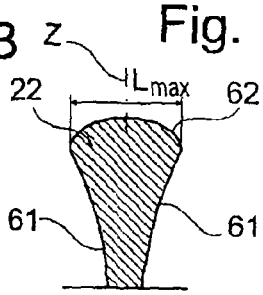
Fig. 11E
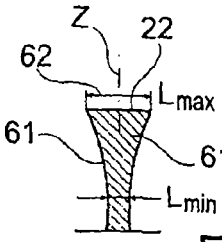
Fig. 11F
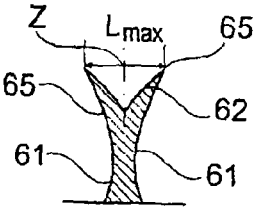
Fig. 11G

APPLICATOR AND A PACKAGING AND APPLICATOR DEVICE INCLUDING SUCH AN APPLICATOR

CROSS REFERENCE

This application is a continuation of and is based upon and claims the benefit of priority under 35 U.S.C. §120 for U.S. Ser. No. 13/810,785, filed Jan. 17, 2013, the entire contents of which is incorporated herein by reference. U.S. Ser. No. 13/810,785 is a National Stage of PCT/1B11/053111, filed Jul. 12, 2011, and claims the benefit of priority under 35 U.S.C. §119 from French Patent Application No. 10 55896, filed Jul. 20, 2010.

The present invention relates to applicators for applying a cosmetic composition to the eyelashes and/or the eyebrows.

The invention relates more particularly to an applicator including an applicator member that is made, at least in part, by molding a thermoplastic material, sometimes also referred to as an injection-molded brush or an injection-molded comb.

Numerous applicator members of this type include teeth that are relatively fine at their free ends, with said teeth being arranged in parallel rows on a core. The teeth have a pyramid or frustoconical shape, and they are wider at their bases than at their free ends. After the applicator member has passed through the wiper member, there generally remains little composition on the teeth, in particular when the diameter of the brush is large relative to the diameter of the orifice of the wiper member.

However, there exists an advantage to having more composition on the teeth, so as to increase the length of time the applicator can be used, and to enable a heavily made-up effect to be achieved, even when the composition used for making up is relatively fluid and is not very thick and/or when the diameter of the applicator member is relatively large compared to the diameter of the wiper orifice.

U.S. Pat. No. 6,539,950 discloses combs for applying makeup to the eyelashes and/or the eyebrows, said combs including a plurality of rows of teeth that may have various configurations, leading to the formation of V-shaped channels when the applicator member is observed from the side.

U.S. Pat. No. 6,546,937 describes combs for applying makeup to the eyelashes and/or the eyebrows, said combs including rows of teeth that slope relative to the longitudinal axis of the applicator member.

U.S. Pat. No. 6,343,607 discloses combs including rows of teeth having the same circumferential orientation.

WO 2010/013213 describes an applicator member including teeth having a narrowing at their bases.

FR 2 744 608 describes a brush having bristles that present branches.

WO 01/05271 describes an applicator having teeth that present portions in relief.

US 2009/0193602 describes an applicator member including first applicator elements that widen on going away from the core and that are arranged in rows, with second applicator elements of shape that tapers outwards being interposed between the rows. The second applicator elements are made by protrusion and are more flexible than the first.

First exemplary embodiments of the invention provide an applicator for applying a composition to the eyelashes or the eyebrows, the applicator including:

an applicator member, comprising:

a core that extends along a longitudinal axis; and at least three rows of applicator elements that are molded with at least one portion of the core, the rows extending longitudinally along the core, and being arranged around the longitudinal axis of the core, the applicator elements being of cross-section that is flat, having a major axis that is oriented substantially perpendicularly to the longitudinal axis of the core, at least two applicator elements having bases that are offset angularly around the longitudinal axis of the core and being superposed, at least in part, when the core is observed along its longitudinal axis.

The fact that at least two applicator elements of cross-section that is flat, better at least half, and still better all of the applicator elements, present bases that are offset angularly around the longitudinal axis of the core, and that are superposed, at least in part, when the core is observed along its longitudinal axis, makes it possible to increase the area of contact of the eyelashes with the composition present on the applicator elements.

Furthermore, by means of the invention, the quantity of composition present on the applicator elements, after passing through the wiper member, may be relatively large, but without that decreasing either the flexibility of the applicator member, or its capacity to separate the eyelashes, enabling the eyelashes that are oriented substantially perpendicularly to the longitudinal axis of the core to be engaged between the applicator elements.

Preferably, at least one row of applicator elements that are molded integrally with at least one portion of the core, in particular at least one of the above-mentioned three rows, includes at least one applicator element having a cross-section of shape that is flat and of major axis that is contained in a plane that is oriented substantially perpendicularly to the longitudinal axis of the core, the applicator element having a width that passes through a maximum at a non-zero distance from the core on going along the applicator element away from the core, and having a thickness that decreases continuously from the core to the point at which the width is at its maximum, and preferably that decreases over the entire height of the applicator element.

Preferably, each of the above-mentioned three rows includes at least one applicator element as defined above; better, at least half of the applicator elements of each row are as defined above; e.g. all of them are as defined above.

The term "applicator element" means an individualizable element, also referred to as a tooth or a bristle, that is used to apply composition and to separate eyelashes.

The term "applicator element of cross-section that is flat" should be understood to mean that the applicator element presents, over at least a fraction of its length, a cross-section, taken perpendicularly to its long direction, that is of elongate shape, i.e. that is wider than it is thick. Preferably, such an applicator element is of cross-section that is flat over at least half of its length, better over all of its length, or possibly only above a section narrowing at the base of the applicator element.

The term "offset bases" should be understood to mean that the bases of two adjacent rows are not superposed exactly when the applicator member is observed along its longitudinal axis. Within a single row, the bases may be exactly in alignment and superposed or arranged in a staggered configuration, being superposed in part only, or they may be separated by a common join plane to which they are tangential.

The term "major axis that is contained in a plane that is oriented substantially perpendicularly to the longitudinal axis of the core" should be understood to mean that the plane is oriented within ±30° relative to a plane that is exactly perpendicular to the longitudinal axis of the core. Preferably, the orientation of the major axis is perpendicular to the longitudinal axis of the core.

The term "row" is used to designate a succession of applicator elements in the longitudinal direction.

Preferably, all of the rows extend along longitudinal axes that are parallel to the longitudinal axis of the core.

Preferably, the widths of the majority of the applicator elements, better still at least three fourths of the applicator elements, pass through a maximum at a non-zero distance from the core.

The maximum width may be reached at one point only of the height of the applicator element, or the width may remain constant and at a maximum over a segment of said height. The maximum width is preferably reached at a point that is situated closer to the free end of the applicator element than to the core, or, in a variant, closer to the core than to the free end.

Preferably, the applicator elements present smaller sections at their bases, or section narrowings that are situated at their bases. The bases of the applicator elements need not be touching. The presence of narrow bases may enable relatively wide teeth to be implanted, said wide teeth offering a large area of contact with the composition and with the eyelashes.

The fact that the thickness of the applicator elements decreases, increases their flexibility at their ends, and may make it easier to unmold the applicator member.

The applicator elements may be oriented in various ways relative to the core.

The long direction of the applicator elements may be radial, i.e. oriented along a radius passing through the center of the core. The long direction of at least one applicator element may also form an angle with a radius passing through the center of the base and the longitudinal axis of the applicator member. The long direction of an applicator element may be perpendicular to the surface of the core onto which the applicator element is connected. When the applicator member is observed in longitudinal section, the long direction of an applicator element may also form an angle with a plane that is perpendicular to the longitudinal axis of the core, the applicator element being oriented towards the distal end of the applicator member or towards its proximal end, for example. The slope of the applicator elements towards the distal or proximal ends may vary within a row depending on the location of the applicator elements along the longitudinal axis of the core, the slope decreasing from the distal end towards an intermediate region of the applicator member and then increasing in the opposite direction towards the proximal end, for example, thereby giving a fan configuration when the applicator member is observed from the side, perpendicularly to the longitudinal axis of the core.

According to a preferred, but optional, characteristic of the invention, the applicator elements have narrow bases. In other words, along the core, the cross-section of the applicator element, taken perpendicularly to its long direction, increases over at least a fraction of the length of the applicator element, towards the free end of the applicator element. The section narrowing may extend as far as the core, or it may begin at a non-zero distance from the core. The width of the applicator element may thus increase from the core over almost the entire height of the applicator element. The presence of a section narrowing may impart increased flexibility to the applicator elements, e.g. while passing through the wiper member, enabling the applicator elements to slope towards the core. In a variant, at their bases, the applicator elements are made integrally with the core out of elastomer, and, beyond their bases, they are made out of a material that is more rigid.

Preferably, the core is of longitudinal axis that is rectilinear.

The end edge of the applicator element may be rectilinear or outwardly-convex when the applicator element is observed along the longitudinal axis of the core. The applicator element need not have branches, in particular at its end.

By way of example, the width of the applicator elements may lie in the range 0.3 millimeters (mm) to 2.5 mm over almost all of their height, i.e. over more than 95% of their height.

The height of the applicator elements may lie in the range 0.6 mm to 3 mm, and their thickness may lie in the range 0.2 mm to 1 mm over almost all of their height, i.e. over more than 95% of their height.

By way of example, the maximum width $L_{max}$ is strictly greater than 0.3 mm and less than 2.5 mm.

By way of example, the maximum thickness is strictly greater than 0.2 mm. The maximum thickness is measured at the base of the applicator element, when the thickness decreases from the base towards the free end of the applicator element.

By way of example, the thickness $\underline{e}$ may decrease by more than 10% on passing over half of the height of the applicator element from the core.

The applicator preferably includes at least 6, better at least 8 or 12, rows having applicator elements that are superposed, with the applicator elements having bases that are offset angularly. All of the applicator elements that are superposed in this way may have a major axis of their cross-section that is oriented perpendicularly to the longitudinal axis of the core.

The maximum width of an applicator element having a cross-section of shape that is flat, is preferably greater than or equal to at least one and a half times its maximum thickness, better twice said thickness.

The number of applicator elements that are carried by the applicator member is preferably greater than or equal to 250, better greater than or equal to 350. All of the applicator elements may be made integrally with all of the core out of a single thermoplastic material.

The applicator elements are preferably arranged in rows, each of axis that is parallel to the longitudinal axis of the core.

A greatest transverse dimension of the envelope surface (E) of the applicator member is preferably greater than or equal to 4 mm.

The applicator member may define an envelope surface (E) of cross-section that is circular or polygonal, preferably circular.

The greatest transverse dimension of the core, in particular its diameter when it is of section that is circular, lies in the range 1.5 mm to 6 mm.

The invention also provides a packaging and applicator device, comprising:

an applicator as defined above; and a container containing a composition for application.

The invention also provides a method of applying makeup to the eyelashes and/or the eyebrows by means of an applicator as defined above.

The invention can be better understood on reading the following detailed description of non-limiting embodiments thereof, and on examining the accompanying drawings, in which:

FIGS. 10A to 10F are views similar to FIG. 9, showing variant embodiments of applicator elements;

FIGS. 11A to 11G are views similar to FIG. 5, showing variant embodiments of applicator elements;

FIGS. 15A to 15I show variant envelope-surface shapes of the applicator member when said applicator member is observed from the side, in a direction that is perpendicular to its longitudinal axis; and FIG. 16 is a fragmentary longitudinal section of a variant embodiment of the applicator member.

Figure 1:
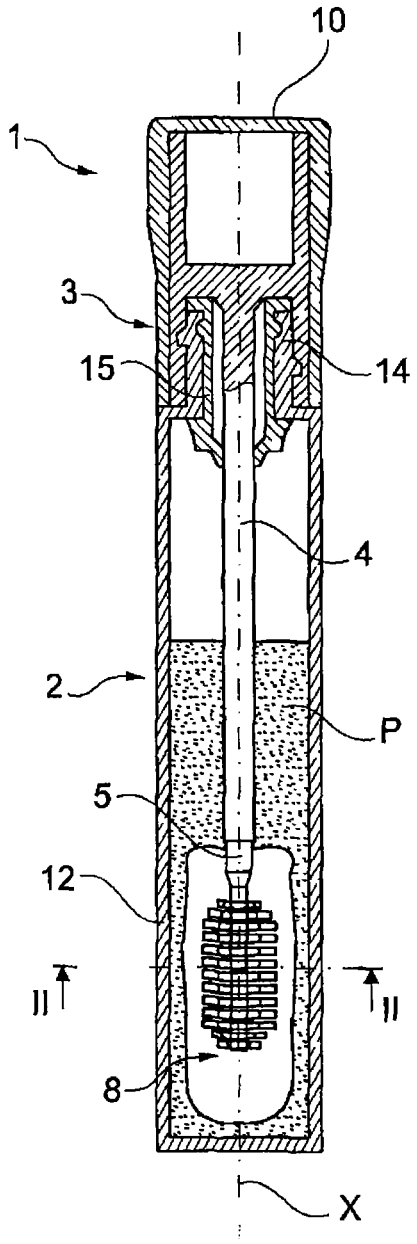
FIG. 1 is a diagrammatic and fragmentary longitudinal section of an example of a packaging and applicator device made in accordance with the invention.

FIG. 1 shows a packaging and applicator device 1 comprising a container 2 containing a composition P for application to the eyelashes and/or the eyebrows, in particular mascara and an applicator 3.

As shown, the applicator comprises a stem 4 that is provided at one end 5 with an applicator member 8, and at the other end with a handle 10 that also constitutes a closure member for closing the container 2.

The container 2 comprises a body 12 that may be provided at its top end with a neck 14, e.g. an externally-threaded neck, on which the handle 10 may be screw-fastened.

A wiper member 15 may be fastened in the neck 14 for wiping the stem 4 and the applicator member 8 while the applicator 3 is being removed from the container 2.

The invention is not limited to using a particular wiper member 15, and the wiper member may be made with a wide variety of shapes, and in particular may be made as described in US publications Nos. 2005/0028834, 2005/0175394, 2004/0258453, 6,375,374, 6,328,495, and 7,455,468.

In particular, the wiper member may be made out of elastomer.

The wiper member may include a wiper orifice of shape that is circular, possibly having slots that are radial or tangential to the wiper orifice.

The diameter of the wiper orifice of the wiper member may lie in the range 3 mm to 5.5 mm, e.g. about 4.5 mm to 5 mm.

The wiper member may possibly include undulations, enabling the wiper orifice to widen more easily when the applicator member passes therethrough.

The wiper orifice may thus be defined by an undulating wiper lip having an inside free edge that defines the wiper orifice. The wiper member may include a number of undulations lying in the range 3 to 12, for example. The wiper lip may extend generally along a cone that converges towards the bottom of the container. The wiper member may also be adjustable, where appropriate. The wiper member may be flocked.

The applicator member 8 includes a core 20 that extends along a longitudinal axis X, which core is rectilinear, for example, as in the embodiment in FIG. 1.

The core 20 carries applicator elements 22, also referred to as teeth, which, in the embodiment shown, are molded integrally with the core 20, e.g. out of a thermoplastic material.

The applicator member may be flexible or rigid.

In order to mold the applicator member 8, it is possible to use any thermoplastic material that is optionally relatively rigid, e.g.: styrene-ethylene-butylene-styrene (SEBS); a silicone rubber; latex rubber; a material having good slip; butyl rubber; ethylene-propylene terpolymer rubber (EPDM); a nitrile rubber; a thermoplastic elastomer; a polyester, polyamide, polyethylene, or vinyl elastomer; a polyolefin such as polyethylene (PE) or polypropylene (PP); polyvinyl chloride (PVC); ethyl vinyl acetate (EVA); polystyrene (PS); SEBS; styrene-isoprene-styrene (SIS); polyethylene terephthalate (PET); polyoxymethylene (POM); polyurethane (PU); styrene acrylonitrile (SAN); polyamide (PA); or polymethyl methacrylate (PMMA). It is also possible to use a ceramic, e.g. an alumina-based ceramic, a resin, e.g. a urea formaldehyde type resin, possibly a material filled with graphite. In particular, it is possible to use materials known under the trade names Teflon®, Hytrel®, Cariflex®, Alixine®, Santoprene®, Pebax®, Pollobas®, this list not being limiting. The material that is used to make the applicator member may contain a biocidal agent.

The core and the teeth may be molded out of the same material or out of different materials. A fraction of the teeth may be molded integrally with the core, e.g. out of a material that is flexible, and the remainder of the teeth may be molded out of a material that is more rigid.

The core 20 may be fastened to the stem 4 in various ways, e.g. by force-fitting, by snap-fastening, by stapling, by molding, by over-molding, or by screw-fastening, amongst other possibilities.

Figure 3:
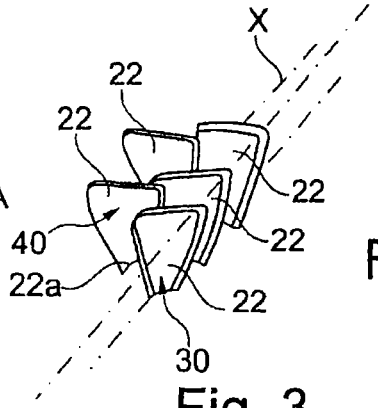
FIG. 3 is diagrammatic perspective view showing an example of an arrangement of applicator elements.

The applicator elements 22 are arranged in rows 30 and 40 along the longitudinal axis X, as can be seen in FIG. 3.

More particularly, and as shown, the applicator member 8 may comprise first rows 30 of teeth 22 that are each arranged between second rows 40, such that the teeth 22 of the rows 30 penetrate between the teeth 22 of the adjacent second rows 40. Thus, when the applicator member 8 is observed along its axis X, it can be seen that each of the teeth of the first rows 30 are superposed, at least in part, with the teeth of a second row 40, while having bases 22*a* for the teeth of the first rows 30 that are offset angularly from the bases 22*a* of the teeth of the second rows 40.

Figure 5:
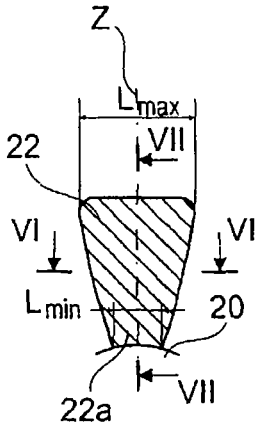
FIG. 5 is a longitudinal section of an applicator element.
Figure 2:
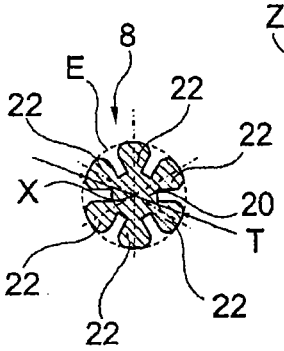
FIG. 2 is a cross-section on II-II in FIG. 1.

FIG. 5 shows a tooth 22 in longitudinal section along its long direction Z.

Each tooth 22 presents a width L that increases on going away from the core 20, at least over a fraction of its length. In the embodiment under consideration, each tooth 22 presents a narrow base 22*a*.

Figure 6:
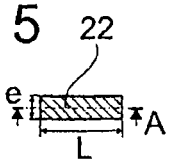
FIG. 6 is a cross-section on VI-VI in FIG. 5.

The tooth 22 may present a cross-section, taken perpendicularly to the axis Z, that is elongate along a major axis A, as shown in FIG. 6. The width L of the tooth 22, along the major axis A, lies in the range 0.3 mm to 2.5 mm, for example, while the thickness e of the tooth 22, measured perpendicularly to the axis A, lies in the range 0.2 mm to 1 mm, for example, the values L and e being given for the entire height of the tooth, except at the end where the values tend very quickly towards 0. The maximum width $L_{max}$ is thus greater than 0.3 mm, and the maximum thickness $e_{max}$ is thus greater than 0.2 mm. By way of example, the maximum width $L_{max}$ is greater than or equal to 1.3 $L_{min}$, where $L_{min}$ is the smallest width at the section narrowing, situated between the core and where the width is at its maximum, or where the tooth is connected to the core, when the width decreases as far as the core. By way of example, for a single tooth 22, $L_{max}/L_{min} \geq 1.5$, preferably $L_{max}/L_{min} \geq 2$.

Figure 7:
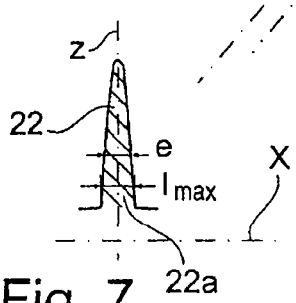
FIG. 7 is a longitudinal section on VII-VII in FIG. 5.

The thickness e of a tooth 22 decreases towards its free end, as shown in FIG. 7; by way of example, at the base of the tooth 22, a maximum thickness $e_{max}$ lies in the range 0.2 mm to 1 mm, better in the range 0.2 mm to 0.7 mm. The thickness e is measured parallel to the longitudinal axis X of the core, when the major axis A is perpendicular to the axis X.

The thickness e may decrease in monotonic manner, or, in a variant, it may decrease in stages, i.e. over at least a segment of the height of the tooth, the thickness is constant.

The major axis A is preferably perpendicular to the axis X, as shown, but a slope is possible.

Figure 4:
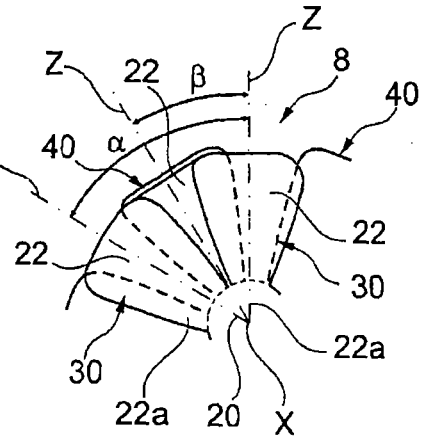
FIG. 4 shows applicator elements that are superposed, at least in part, when the applicator member is observed along its longitudinal axis.

The long direction Z of the teeth may be oriented radially, as shown in FIG. 4.

By way of example, the angular spacing a around the axis X between the first rows 30 of teeth 22 is 60°, as in the embodiment in FIG. 4, being measured between the long directions of the teeth.

The teeth of the rows 40 that are interposed between the teeth of the rows 30 are offset angularly from the first rows 30 by an angle $\beta=\alpha/2$.

The teeth 22 of the first rows 30 may occupy the same axial positions from one row 30 to another, and the same may apply for the rows 40.

The teeth of a row 40 may be axially offset by half of the pitch between the teeth of the first rows, giving rise to a regular staggered configuration along the core for the teeth of two adjacent rows 30 and 40.

The teeth of the rows 30 and 40 may be superposed over the entire height of the teeth 22 or over a fraction only of said height, e.g. with overlap occurring at the base 22*a* of the teeth, or better above said base, in particular when the base 22*a* is narrow.

The greatest transverse dimension T of the envelope surface E may be greater than or equal to 4 mm.

Figure 8:
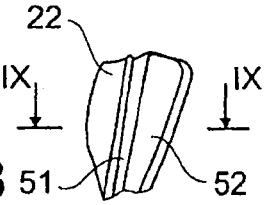
FIG. 8 is a perspective view showing another example of an applicator element in isolation.

The teeth 22 may have various shapes, without going beyond the ambit of the present invention. For example, the teeth 22 may be made with one or more splines 51, as shown in FIG. 8, so as to impart greater rigidity thereto and/or to form portions in relief that are suitable for retaining more composition. The splines 51 extend parallel to the long direction of the teeth. The thickness of the splines 51, measured along the axis X, may decrease towards the free end of the tooth.

Figure 9:
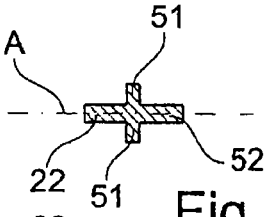
FIG. 9 is a cross-section on IX-IX in FIG. 8.

In the embodiment in FIGS. 8 and 9, on either side of a central body 52 of shape that is flat in cross-section, the tooth 22 includes splines 51 that extend over the entire height of the tooth 22.

FIGS. 10A to 10F show other shapes, amongst others, of cross-sections for the teeth.

The cross-section of the teeth 22 need not have a shape that is symmetrical about a mid-plane M, as shown in FIG. 10A, the cross-section of the tooth presenting a step 53 for example, connecting two portions that are arranged on either side of the mid-plane M respectively.

The cross-section of the teeth may have a shape that is oblong, e.g. lens-shaped, as shown in FIG. 10B, or lozenge-shaped, as shown in FIG. 10C.

The teeth may also have a shape that is asymmetrical about the small axis B of the cross-section, as shown in FIG. 10D.

FIG. 10E shows a cross-section of a tooth 22 having an hourglass shape, and FIG. 10F shows a cross-section of a tooth 22 having an H-shape.

When the tooth is observed in longitudinal section along its long axis, the tooth may have a variety of possible shapes, while having a width L that increases towards the free end of the tooth, over at least a fraction of the height of the tooth, for example.

For example, as shown in FIG. 11A, the tooth 22 may have opposite side edges 61 that define between them the width L, that are rectilinear, and that are interconnected via a distal end edge 62 that is also rectilinear.

The tooth 22 of the variant in FIG. 11B differs from the variant in FIG. 11A, in particular by the fact that the end edge 62 is rounded, e.g. circularly centered on the longitudinal axis X of the core, or not centered thereon.

In the embodiment in FIG. 11C, the tooth 22 presents side edges 61 that firstly diverge over portions 61*a*, and then converge over portions 61*b*, which portions may be rectilinear, as shown.

FIG. 11D shows a tooth 22 having side edges 61 that are curvilinear, concave towards each other.

In FIG. 11E, the tooth is shown with side edges 61 that are convex towards each other and that are connected to a distal end edge 62 that may, as shown, be outwardly convex.

In FIG. 11F, the side edges 61 are convex towards each other and are connected to a distal end edge 62 that is rectilinear and that is perpendicular to the long direction Z, for example.

Where appropriate, the distal end edge 62 may define one or more tips 65, as shown in FIG. 11G.

Figure 12:
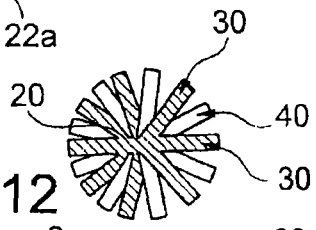
FIG. 12 is a cross-section of a variant embodiment of the applicator member.

In FIG. 12, it can be seen that the teeth may present a width that is substantially constant.

In general, the applicator member may, when it is observed in section in a cross-section plane that is perpendicular to the longitudinal axis X of the core, present a section that is symmetrical about the axis X. In a variant, the section may be asymmetrical, as in the sections shown in FIGS. 13C and 13D, in particular.

Figure 13C:
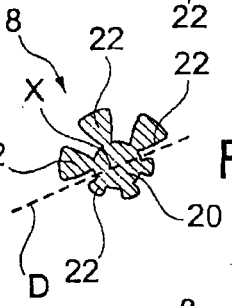
FIGS. 13A to 13D are cross-sections of variant embodiments of the applicator member.

FIG. 13C shows a cross-section of an applicator member that, on one side of a separator plane D that may contain the axis X, presents teeth 22 of greater width and height than on the other side of the separator plane D. All of the teeth may present narrow bases.

Figure 13A:
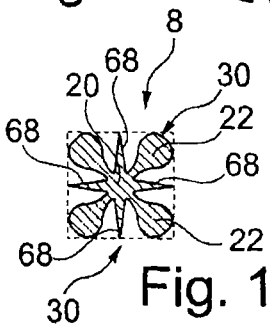
Figure 13B:
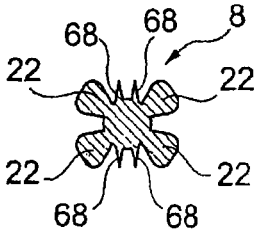
Figure 13D:
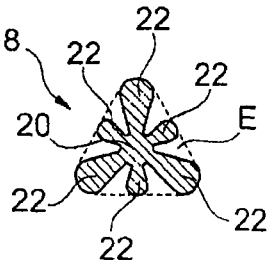

FIG. 13D shows an applicator member having, in cross-section, an envelope surface E of outline that is substantially polygonal, specifically triangular. The applicator member may include long teeth 22 that are arranged at the vertices of the triangle, and shorter teeth that are arranged in the middles of the sides of the triangle, all of the teeth optionally having narrow bases, as shown.

FIG. 13A shows an applicator member having teeth 22 that are superposed, at least in part, when the applicator member 8 is observed along its longitudinal axis X, with other teeth, not visible in this figure, that occupy a different axial position along the axis X and that have bases that are offset angularly. By way of example, and as shown, additional teeth 68 are arranged between the teeth 22, the additional teeth 68 not being arranged to be superposed with teeth that are offset angularly relative thereto. Each row may alternate the teeth 22 and 68 along the core.

FIG. 13D shows an applicator member 8 having long teeth 22 having narrow bases, and additional teeth 68 having wide bases, for example.

Figure 14:
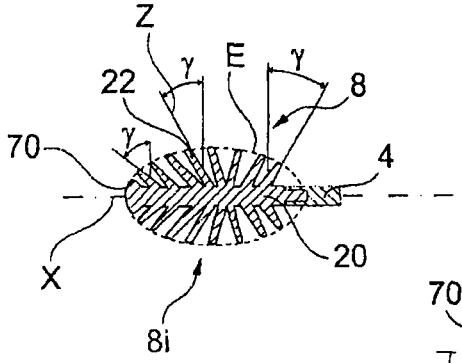
FIG. 14 is a longitudinal section of a variant applicator member.

The slope of the long direction Z of a tooth 22 relative to the longitudinal axis X of the core 20 may form a non-zero angle $\gamma$ relative to a plane that is perpendicular to the axis X, as shown in FIG. 14.

The angle $\gamma$ may vary within a row depending on the position occupied by the tooth 22 along the longitudinal axis X of the row. In the embodiment in FIG. 14, the angle $\gamma$ thus passes from a relatively high value in the proximity of the distal end 70 of the core, to a smaller value in an intermediate region 8*i* of the applicator member 8, and then changes direction and slopes rearwards towards the proximal end of the applicator member, as shown.

In longitudinal section, the applicator member 8 may have various shapes of envelope surface E.

Figure 15A:
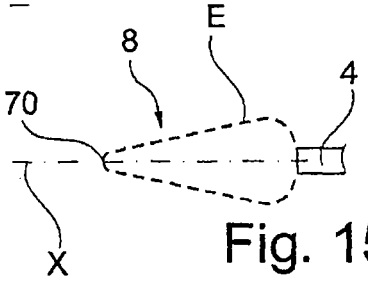

The envelope surface E may have a shape that tapers towards the distal end of the applicator member, as shown in FIG. 15A, e.g. a frustoconical or pyramid shape.

Figure 15B:
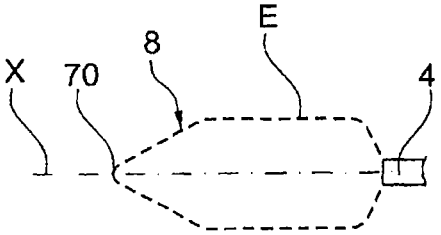

The envelope surface E may include at least one segment that is circularly cylindrical, as shown in FIG. 15B.

Figure 15H:
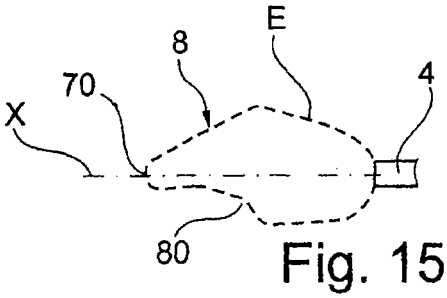
Figure 15C:
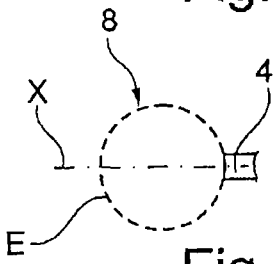
Figure 15G:
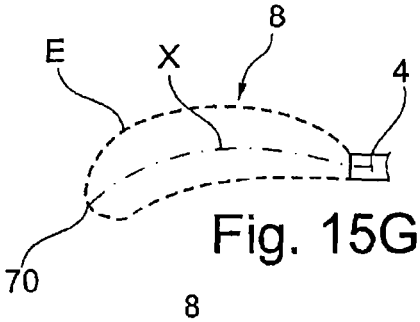
Figure 15D:
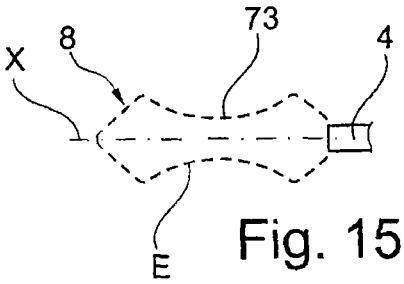
Figure 15E:
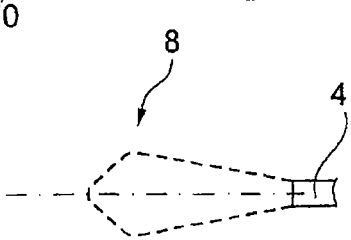

The envelope surface E may present the shape of a ball, as shown in FIG. 15C, or it may be peanut-shaped, as shown in FIG. 15D.

The diameter of the envelope surface E may thus pass through two maximums and through a minimum between the maximums.

Figure 15F:
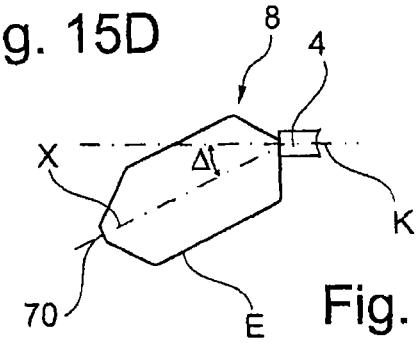

The longitudinal axis X of the core may form an angle Δ with the longitudinal axis K of the stem, as shown in FIG. 15F. Thus, the distal end 70 of the applicator member need not be situated in the extension of the longitudinal axis K of the stem 4.

FIG. 15G shows an applicator member 8 having a longitudinal axis X that is curvilinear.

The distal end 70 need not be situated in the extension of the longitudinal axis K of the stem, as shown, or, in a variant, may be situated in the extension of said longitudinal axis.

FIG. 15H shows an applicator member 8 having an envelope surface E of shape that is not symmetrical about the axis X, e.g. with a step 80 on one side.

The envelope surface E may have a shape as described in application EP 0 811 837 and shown in FIG. 15I with one longitudinal edge that is substantially rectilinear and an opposite edge that is outwardly concave.

All of the teeth 22 need not have the same shape around the core 20, and FIG. 16 shows a variant in which the applicator member includes, on one side, teeth having a thickness e that decreases from their base as far as their free ends, in accordance with exemplary embodiments of the invention, and on the other side, teeth provided with respective wide ends 83.

The applicator member may be magnetic or magnetizable.

The applicator member may be twisted, i.e. the core is twisted and the rows follow a helical path.

In use, the applicator member may be subjected to vibration and/or to heat from a heater element and/or it may be driven in rotation, e.g. all three simultaneously.

The applicator member may include a plurality of rows, in particular four, that are each arranged in accordance with the teaching of US application No. 2006/0002758, or a plurality of rows that are arranged in accordance with the teaching of application FR 2 922 422.

Naturally, the invention is not limited to the embodiments described above. In particular, various modifications could be applied to the examples shown, within variants that are not shown.

In a variant, the container could be a container having a volume that varies or having at least one chamber of volume that varies.

The container could thus be as described in application US 2005/0232681, and could include two chambers of volume that varies and that are defined, at least in part, by a movable wall, the movement of which causes composition contained in one of the chambers to pass to the other chamber.

The applicator member could be in accordance with the teaching of WO 2009/153753, and in particular could be situated in the proximity of, or in contact with, the inside surface of the container, in particular so as to homogenize the composition that is contained in the container.

The expression "comprising a" should be understood as being synonymous with "comprising at least one" unless specified to the contrary.

The invention claimed is:

1. An applicator for applying a composition to eyelashes or eyebrows, the applicator comprising:

an applicator member, comprising:

a core that extends along a longitudinal axis; and rows of applicator elements that are molded with at least one portion of the core, the rows extending longitudinally along the core, and being arranged around the longitudinal axis of the core, the applicator elements being of cross-section that is flat, having a major axis that is oriented substantially perpendicularly to the longitudinal axis of the core, at least two applicator elements having bases that are offset angularly around the longitudinal axis of the core and being superposed, at least in part, when the core is observed along the longitudinal axis; and a point, along a long axis of the applicator element, at which the width is at a maximum, being situated closer to a free end of the applicator element than to the core.

2. An applicator according to claim 1, wherein at least one row of applicator elements is molded integrally with the core, including at least one applicator element having a cross-section of shape that is flat and of major axis that is contained in a plane that is oriented substantially perpendicularly to the axis, the applicator element having a width that passes through a maximum at a non-zero distance from the core on going away from the core, and having a thickness that decreases continuously from the core to at least the point at which the width is at its maximum, or a thickness that decreases over an entire height of the applicator element.

3. An applicator according to claim 2, comprising plural rows of applicator elements extending longitudinally along the core, and being arranged around the longitudinal axis of the core, the applicator elements of the plural rows being of cross-section that is flat and of major axis that is contained in a plane that is oriented substantially perpendicularly to the longitudinal axis of the core, at least two applicator elements of the plural rows having bases that are offset angularly around the longitudinal axis of the core, and the applicator elements being superposed, at least in part, when the core is observed along its longitudinal axis.

4. An applicator according to claim 1, the applicator elements that are superposed and that have bases that are angularly offset from each other, have a section narrowing at their bases.

5. An applicator according to claim 1, including at least 6, 8, or 12 rows having applicator elements that are superposed, with the applicator elements having bases that are angularly offset from each other.

6. An applicator according to claim 1, the applicator elements that are superposed having a major axis that is oriented perpendicularly to the longitudinal axis of the core.

7. An applicator according to claim 1, at least half of the applicator elements of the applicator member being superposed, at least in part, with other applicator elements having bases that are angularly offset from each other.

8. An applicator according to claim 1, the maximum width of an applicator element having a cross-section of shape that is flat, being greater than or equal to at least one and a half times its maximum thickness, or twice the thickness.

9. An applicator according to claim 1, a number of applicator elements that are carried by the applicator member being greater than or equal to 250, or greater than or equal to 350.

10. An applicator according to claim 1, the applicator elements being arranged in rows, each of axis that is parallel to the longitudinal axis of the core.

11. An applicator according to claim 1, the width of the applicator element increasing from the core over almost an entire height of the applicator element.

12. An applicator according to claim 1, an end edge of the applicator element being rectilinear or outwardly-convex when the applicator element is observed along the longitudinal axis of the core.

13. An applicator according to claim 1, the applicator member defining an envelope surface of cross-section that is circular or polygonal.

14. A packaging and applicator device, comprising:

an applicator as defined in claim 1; and a container containing a composition for application.

15. An applicator according to claim 1, the applicator member comprising at least three rows.

* * * * *